United States Patent [19]

Bergmann et al.

[11] Patent Number: 4,783,939

[45] Date of Patent: Nov. 15, 1988

[54] COVERING FOR IMPROVING WORN OUT STEPS

[75] Inventors: Gunther Bergmann, Neunkirchen; Florestan F. V. Kunsberg, Mainleus, both of Fed. Rep. of Germany

[73] Assignee: Freiher von Kunssberg Vertriebsgesellschaft GmbH, Waldershot, Fed. Rep. of Germany

[21] Appl. No.: 6,654

[22] PCT Filed: May 15, 1986

[86] PCT No.: PCT/EP86/00289

§ 371 Date: Mar. 16, 1987

§ 102(e) Date: Mar. 16, 1987

[87] PCT Pub. No.: WO86/06778

PCT Pub. Date: Nov. 20, 1986

[30] Foreign Application Priority Data

May 15, 1985 [DE] Fed. Rep. of Germany ..... 3517673

[51] Int. Cl.[4] ..... E09F 11/00

[52] U.S. Cl. ..... 52/188; 52/182; 52/514

[58] Field of Search ..... 52/182, 184, 188, 514

[56] References Cited

U.S. PATENT DOCUMENTS

| | | | |
|---|---|---|---|
| 1,536,895 | 5/1925 | Lindyberg | 52/514 |
| 1,812,504 | 6/1931 | Del Turco | 52/188 |
| 2,842,813 | 7/1958 | VanFleet | 52/182 |
| 2,909,918 | 10/1959 | Robinson | 52/182 |
| 4,464,870 | 8/1984 | Crepeau | 52/188 |

FOREIGN PATENT DOCUMENTS

| | | | |
|---|---|---|---|
| 964983 | 5/1957 | Fed. Rep. of Germany . | |
| 2302299 | 1/1973 | Fed. Rep. of Germany . | |
| 8407239 | 3/1984 | Fed. Rep. of Germany . | |
| 1373455 | 10/1963 | France | 52/188 |

*Primary Examiner*—Carl D. Friedman
*Assistant Examiner*—Creighton Smith
*Attorney, Agent, or Firm*—Helfgott & Karas

[57] ABSTRACT

The covering (20) for repairing worn-out steps has two unitary flanges (21, 22, 25, 29) linked together, and is made of step and scuff resistant plastic. At least the capping (21) comprises at its underside facing the step (10) an insert of press board, which has less specific weight as the plastic (23) of the covering (FIG. 1).

9 Claims, 1 Drawing Sheet

COVERING FOR IMPROVING WORN OUT STEPS

The invention relates to a covering for improving worn-out steps according to main claim 1.

Such covering is known from DE-GM No. 84 07 239.

According to this reference, there is provided a one-piece, I-shaped profile made of plastic material, which is bonded with a binding filler onto the steps to be repaired.

The plastic used, for example, polyurethane, must be extremely solid for the intended purpose. For example, it should be scuff and shock resistant. The polyurethane plastic required for this purpose has a high specific weight and is relatively expensive. Also, it has been found that the binding with the step is not safe.

It is an object of the present invention to improve the covering mentioned above in order that its binding with the steps to be repaired be safer and that its assembly be facilitated.

This object can be achieved by the features given in the characterizing part of claim 1.

Advantageous embodiments and further developments of the invention are given in the sub-claims.

Because of the relatively rough surface of the press board, biding with the step to be repaired has become much safer. Furthermore, because of the lesser specific weight of the press board in comparison to polyurethane, the covering becomes somewhat lighter, which naturally also facilitates the assembling and reduces the transportation costs. It should also be pointed out that the cost for the production of the covering would be somewhat reduced, because for one covering for a step to be repaired, about 2 kilograms of polyurethane can be saved which can be replaced by somewhat less expensive press boards. In spite of this, the resistance (and also the value, the step and bending resistance, etc.) on the whole is not worse than a covering entirely made of polyurethane.

A wood fiber flooring bonded with rubber or plastic is known according to DE-PS 964 983. The object of that reference is to provide an entire covering which is as waterproof as possible. In addition, this reference makes no mention of the fact that the above covering can be used for repairing the steps.

Figure 1:
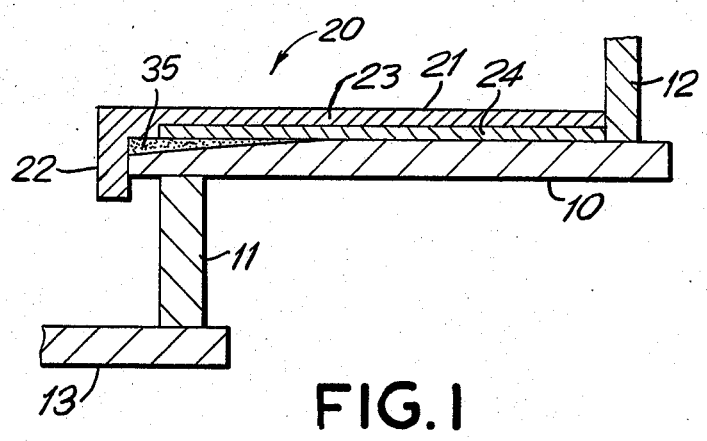
Figure 2:
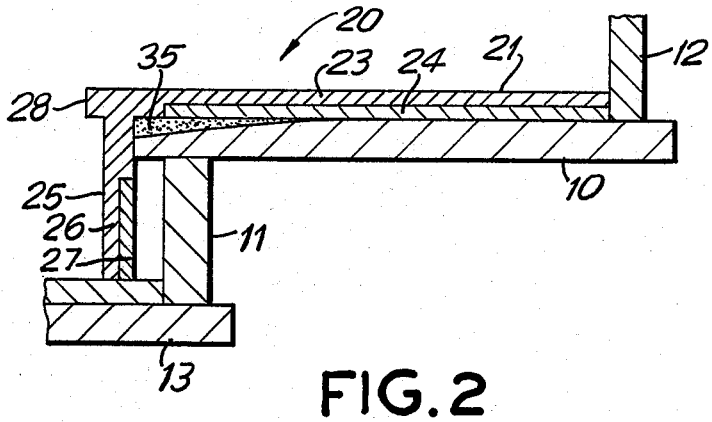
Figure 3:
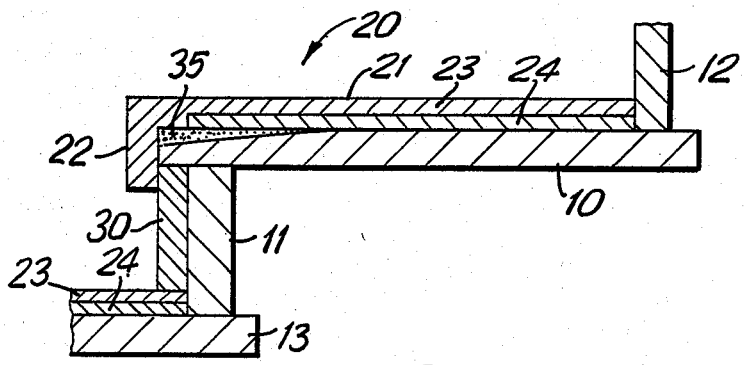
Figure 4:
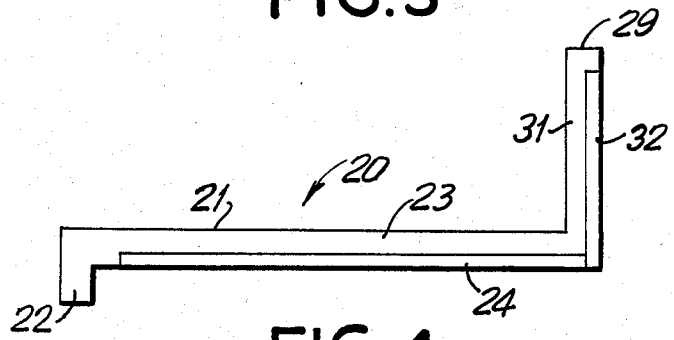

The invention will now be illustrated by means of the following drawings, in which:

FIGS. 1 to 3 are sectional views of various embodiments of coverings according to the invention; and FIG. 4 is a side view of a covering according to a further embodiment of the invention.

FIGS. 1 to 3 show a step of a flight of stairs, including a worn-out step and two adjacent risers 11 and 12 as well as two other adjacent steps 13 and 14 (FIG. 3). The step 10 is extended by means of a step edge over the riser 11 and, therefore, hangs thereover. It should, however, be mentioned that the invention can also be applied to a flight of stairs, in which the steps and risers constitute a unit without such overhang.

A covering 20 is laid on the steps to be repaired in the following manner:

In principle, the covering includes a capping 21 and a flange which is unitary and perpendicular thereto, and which is also parallel to the adjacent riser. According to the invention, at least the capping 21 has at its underside a press board insert 24 which is placed on the opposite side of step 10, and which has a lesser specific weight in comparison to the rest of the plastic covering 20. This insert is placed in position during the preparation of the covering in a cast or a mold and is strongly bonded with the plastic material. Preferably, the thickness of the press board 24 is about the same as the thickness of the capping 21, in order that it comprise half plastic material 23 and half lighter material of the press board 24.

The insert can extend entirely over the width of the covering and, as shown according to the preferred embodiments of FIGS. 1 to 3, can extend to the rear in the direction of the corresponding riser 12 in a manner such that the rear portion of the covering extends to the front face of the riser 21. However, it is also possible to provide borders all around the insert so that its front sides are bordered with plastic material.

The use of the press boards as insert material has the following advantages:

The material has, in comparison to plastic, a somewhat lesser specific weight, is cheaper to buy, and has sufficient resistance with respect to the force of pressure and bending force. Also, because of its surface structure, it combines well with moldable plastic, such as polyurethane or a PU-molding elastomer, so that even under heavy use, the different layers of steps will not separate one from the other.

The embodiment according to FIG. 1 shows flange 22 which is perpendicular to and unitary with capping 21. The flange 22 covers the front edge of step 10 to be repaired, but is, however, generally spaced with respect to the corresponding riser 11. As shown in FIG. 3, the riser 11 can be lined with a separate panel 30, which is supported by the projecting part of the flange 22 which extends past the bottom edge of step 10.

The embodiment illustrated in FIG. 2 shows a flange 25 which is parallel to riser 11 and is a continuation of the flange of covering 20, i.e., it is long enough to completely cover the riser 11. Its length, therefore, corresponds to that of the riser. According to the embodiment illustrated in FIG. 2, the flange 25 also provides for an insert 27 made of a press board. Thus, the flange 25 is made of a double layer, namely, of plastic material 26 and press board 27.

It will also be recognized, with reference to FIG. 2, that the capping 21 can be extended over the flange 25 which extends perpendicularly thereunder to form a step edge 28. Such a step edge can obviously be provided in the embodiments according to FIGS. 1 and 3.

As is well known, the covering according to the invention is bonded by means of a binder 35 to at least the entire step 10 and, according to the embodiments of FIGS. 3 and 4, also the risers 11 and 12 will be covered with the binder 35, so that, on the one hand, there will be obtained a binding of the entire surface, and, on the other hand, the worn-out indentations of the steps 10 to be repaired will be completely covered.

Although this is not shown in the drawings, the capping, according to the invention, can be provided with a slide resisting means in the front portion thereof, for example, by means of a known formation or a groove containing an insert of slide resisting material, such as, for example, rubber.

The embodiments of the invention in which an exclusive property or privilege is claimed are defined as follows:

1. A covering for repairing worn-out steps, said covering having a unitary profile, and at least a capping (24) and a flange perpendicular thereto, said covering extending the entire width of the step, and at least in the area of the visible surfaces to be seen after assembly, being made of moldable hardened plastic said capping being provided on its underside with an insert of press board (24) which has a lower specific weight than the plastic material.

2. A process according to claim 1 wherein the flange (29) is provided at its rear with an insert made of press board (24) which has a lower specific weight than the plastic, said plastic being polyurethane.

3. A covering according to claim 1, characterized in that the thickness of the insert (24, 27) is half the thickness of the corresponding flanges (21, 25, 29).

4. A covering according to claim 3, characterized in that the flange (22) is shorter than the height of a step to be repaired.

5. A covering according claim 4, characterized in that the flange (25) has a length which corresponds to the height of the step to be repaired.

6. A covering according to claim 5, characterized by a Z-shaped cross-section, whereby the upper side of the capping (21) extends past the flange (29), the length of said flange corresponding to the height of the step to be repaired and extends from the underside of the capping (21) by means of a shorter flange portion (22).

7. A covering according to claim 6, characterized in that the flange (29) is also provided with a recess which is filled with a material (32) which has a lesser specific weight than the plastic material.

8. A covering according to claim 7, characterized in that the upper side of the capping (21) and the front side of the flange (29), is shaped to correspond to a wood grain.

9. A covering according to claim 8, characterized in that the shaped surfaces are covered with a lacquer.

* * * * *